US006517442B1

(12) United States Patent
Post

(10) Patent No.: US 6,517,442 B1
(45) Date of Patent: Feb. 11, 2003

(54) PORTABLE ICE SKATING RINK ENCLOSURE

(76) Inventor: Robert E. Post, 12 Osage Dr., Wallingford, CT (US) 06492

( * ) Notice: Subject to any disclaimer, the term of this patent is extended or adjusted under 35 U.S.C. 154(b) by 0 days.

(21) Appl. No.: 09/956,365

(22) Filed: Sep. 18, 2001

(51) Int. Cl.[7] ..... A63C 19/10
(52) U.S. Cl. ..... 472/90; 472/92; 256/25
(58) Field of Search ..... 472/90, 92, 93, 472/94; 256/24, 25, 30, 31

(56) References Cited

U.S. PATENT DOCUMENTS

| | | | | | |
|---|---|---|---|---|---|
| 2,723,107 | A | * | 11/1955 | Parker | 256/24 |
| 2,996,896 | A | | 8/1961 | Johnson | |
| 3,012,596 | A | | 12/1961 | Skolout | |
| 3,709,489 | A | | 1/1973 | Holleran et al. | |
| 3,844,539 | A | * | 10/1974 | Abbott | 256/24 |
| 3,930,647 | A | | 1/1976 | Berlemont | |
| 3,935,687 | A | * | 2/1976 | Vaughn et al. | 472/94 |
| 4,198,042 | A | * | 4/1980 | Olson | 105/422 |
| 4,815,301 | A | | 3/1989 | Deloughery | |
| 5,669,227 | A | | 9/1997 | Morris | |
| 5,738,588 | A | * | 4/1998 | Esser | 256/24 |
| 5,771,706 | A | | 6/1998 | Lavigne | |
| 5,937,586 | A | | 8/1999 | Scherba | |
| 6,004,218 | A | | 12/1999 | Keating et al. | |

* cited by examiner

*Primary Examiner*—Kien T. Nguyen
(74) *Attorney, Agent, or Firm*—Bachman & LaPointe, P.C.

(57) ABSTRACT

The present invention relates to an enclosure which has a plurality of utilities such as a portable ice skating rink, a wading pool, a volleyball area, and a garden enclosure. The enclosure has a pair of opposed sidewalls and a pair of opposed end walls. Each of the sidewalls is defined by at least one elongated sidewall member and each of the end walls is defined by at least one elongated end wall member. A plurality of corner members define an enclosed area with the end walls and the sidewalls. The enclosure further has at least one sheet member positioned over the sidewalls, the end walls, and the corner members. The enclosure further has cover members which fit over the elongated sidewall members, the end wall members, and the corner members to hold and protect the at least one sheet member.

28 Claims, 6 Drawing Sheets

PORTABLE ICE SKATING RINK ENCLOSURE

BACKGROUND OF THE INVENTION

The present invention relates to an enclosure which has utility as a portable ice skating rink, a wading pool, a garden enclosure, and a volleyball area.

Many people have constructed ice skating rinks by flooding flat areas of their yards and gardens so that ice can form to provide a skating area during winter weather. The loss of water during thaws, as well as the difficulty and discomfort encountered in the flooding procedure, have led others to develop skating rinks which can be assembled in one's backyard. These portable skating rinks have been the subject of a number of U.S. patents.

U.S. Pat. No. 3,012,596 to Skolout, for example, illustrates one such portable ice skating rink. The Skolout ice rink has a length of flexible wall or a tube member made of extruded plastic material. The tube member is formed to have an elongated rectangular cross section so that flat faces are available for engagement with surfaces such as asphalt pavement or concrete. A connecting device is provided for holding the abutting ends of the wall in engagement. For installations, where it is desirable to provide a waterproof container within the wall, a sheet of plastic material is provided to fit the area and to extend beyond the wall. A plurality of clips are provided to be spaced along the wall. The clips have outwardly extending feet which, when the clip is in position, lie substantially in the plane of the bottom of the wall and serve to retain the plastic in its desired position and to hold the wall upright. The clips are used for the latter purpose whether or not the waterproof sheet is employed. Walls of increased height may be constructed by placing two of the wall sections one on top of the other and bonding them together with a suitable cement such as liquid latex.

U.S. Pat. No. 2,996,896 to Johnson illustrates a portable skating rink having wood members forming a frame and sheeting arranged to extend through the area defined by the frame with its major portions arranged to rest on a supporting surface and with its edge portions upturned and secured to the frame for the formation of an ice-containing enclosure. The sheeting is preferably made of a polyethylene plastic.

U.S. Pat. No. 4,815,301 to Deloughery relates to a portable ice skating rink comprising a liner having end portions capable of being raised to an essentially rectangular position in relation to the liner and rink blocks having a main body containing a cavity capable of receiving the end portions of the liner through a slotted opening. The end portions of the liner are inflatable. The rink also includes locks for interconnecting the rink blocks.

Still other portable ice skating rinks are shown in U.S. Pat. No. 3,709,489 to Holleran et al., U.S. Pat. No. 3,930,647 to Berlemont, U.S. Pat. No. 5,669,227 to Morris, U.S. Pat. No. 5,771,706 to Lavigne, U.S. Pat. No. 5,937,586 to Scherba, and U.S. Pat. No. 6,004,218 to Keating et al.

Despite the existence of these portable skating rinks, there remains a need for a portable skating rink which is easy to assemble and disassemble and which can be erected in an individual's backyard. There also remains a need for a portable skating rink which is relatively inexpensive.

SUMMARY OF THE INVENTION

Accordingly, it is an object of the present invention to provide an enclosure which may be used as a portable ice skating rink, a wading pool, a volleyball area, and/or a garden enclosure.

It is a further object of the present invention to provide an enclosure which is formed by lightweight components that can be easily assembled and disassembled.

The foregoing objects are attained by the enclosure of the present invention.

In accordance with the present invention, an enclosure which has utility as a portable ice skating rink, a wading pool, a volleyball area and/or a gardening enclosure is provided. The enclosure broadly comprises a pair of opposed sidewalls and a pair of opposed end walls. Each of the sidewalls is defined by at least one elongated sidewall member. Each of the end walls is defined by at least one elongated end wall member. The enclosure further has a plurality of corner members defining an enclosed area with the end walls and the sidewalls. Each of the corner members is positioned between one of the sidewalls and one of the end walls. At least one sheet member is placed over the sidewalls, the end walls, and the corner members, preferably to allow a body of water and/or ice to be located within the enclosure. The enclosure further has means for holding the at least one sheet member in place and for protecting the at least one sheet member along the sidewalls and the end walls from being cut by a sharp instrument such as a blade of an ice skate.

Other details of the enclosure of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
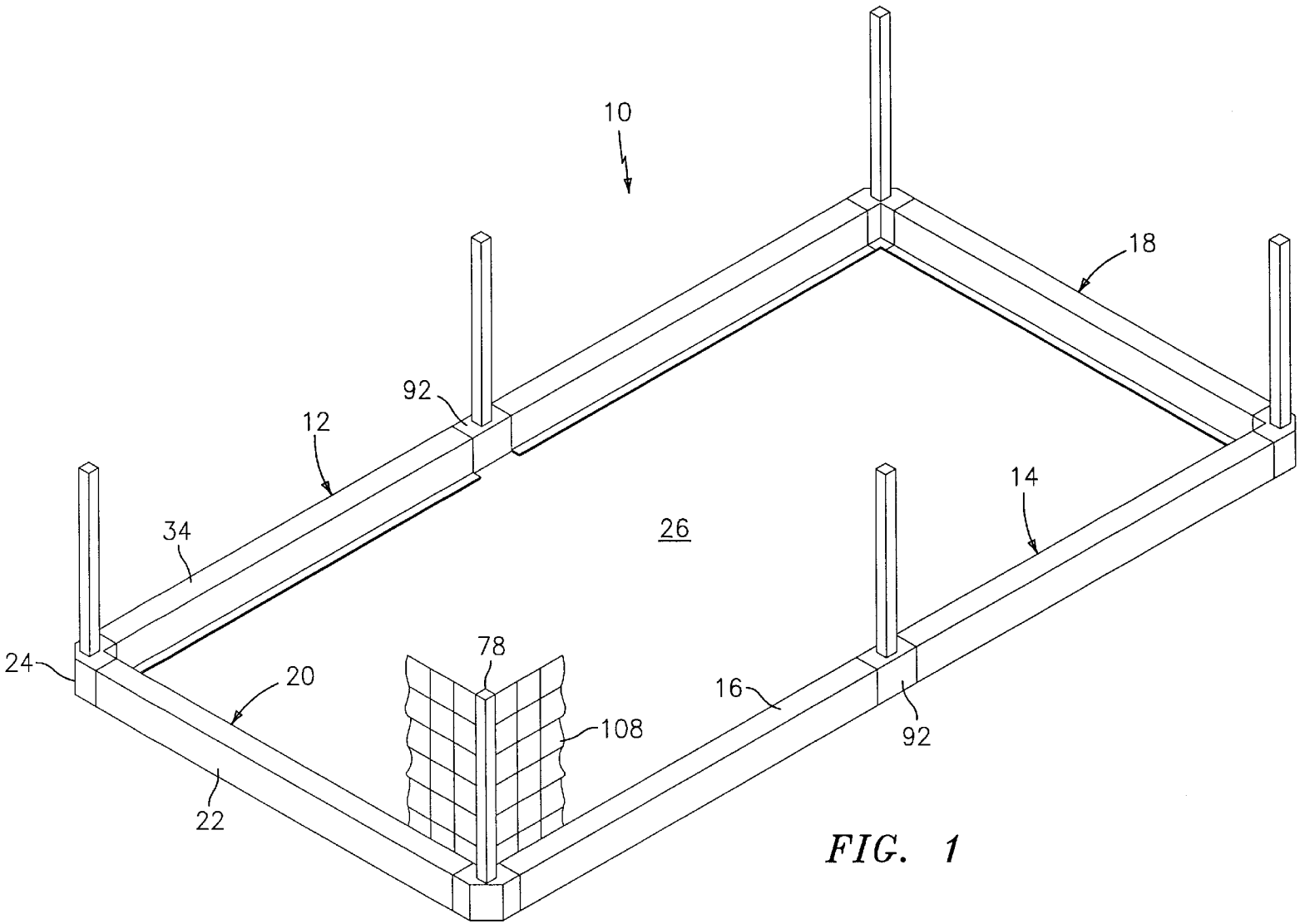
FIG. 1 is a schematic representation of an enclosure in accordance with the present invention.

Referring now to the drawings, FIG. 1 illustrates an enclosure 10 formed in accordance with the present invention. The enclosure 10 may be used as a portable ice skating rink, a swimming pool, and/or a garden enclosure.

The enclosure 10 has two sidewalls 12 and 14 defined by one or more elongated sidewall members 16 and two end walls 18 and 20 defined by one or more elongated end wall members 22. The enclosure further has corner members 24 for joining the end walls 18 and 20 with the sidewalls 12 and 14. The sidewalls 12 and 14, the end walls 18 and 20, and the corner members 24 define an enclosed area 26.

As can be seen from FIGS. 2–5, each elongated sidewall member 16 is preferably formed from a lightweight plastic material and has a cross section which is hollow and substantially rectangular in shape. While it is preferred to form each sidewall member 16 with a substantially rectangular shaped cross section, each member 16 may also be formed with a substantially square cross section if desired. Each sidewall member 16 may have any desired height.

Figure 3:
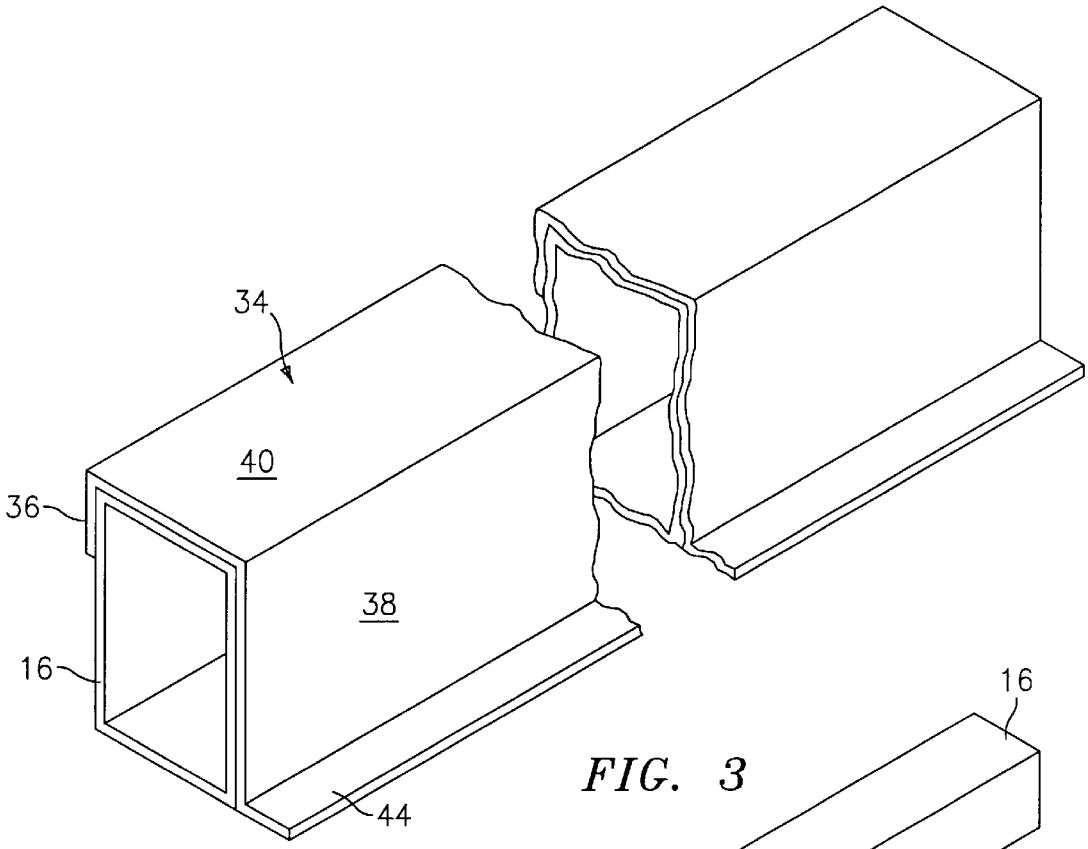
FIG. 3 is a perspective view of a sidewall member having a cover positioned over the sidewall member.
Figure 2:
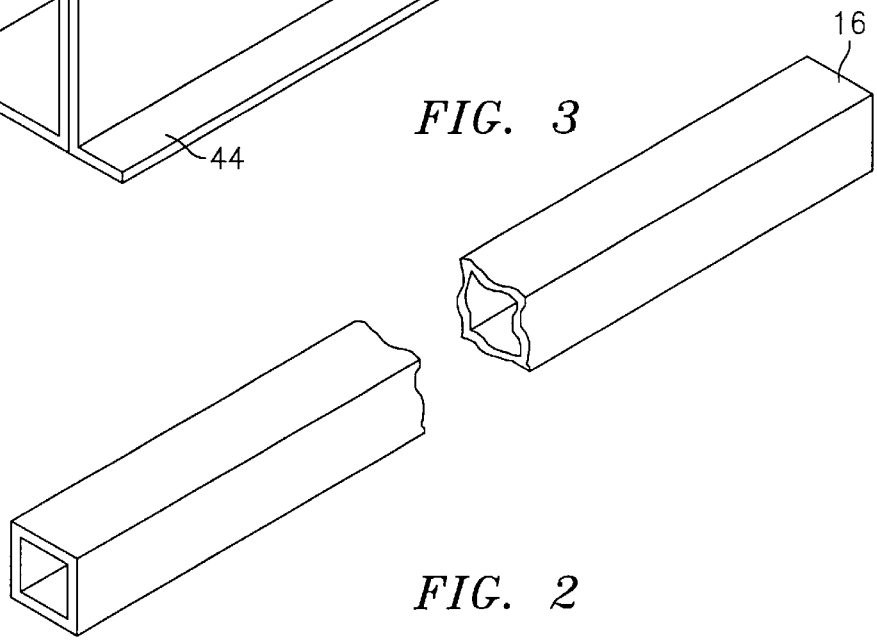
FIG. 2 is a perspective view of a sidewall member used in the enclosure of FIG. 1.
Figure 5:
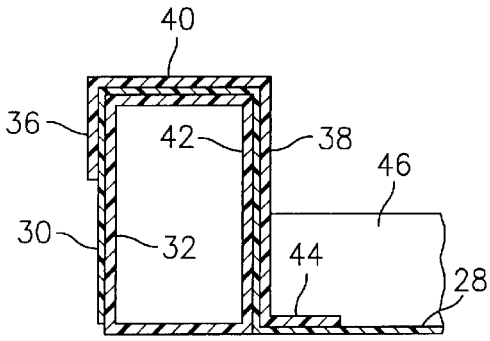
FIG. 5 is a sectional view showing of a sidewall member showing the cover holding a water impervious member in place.
Figure 4:
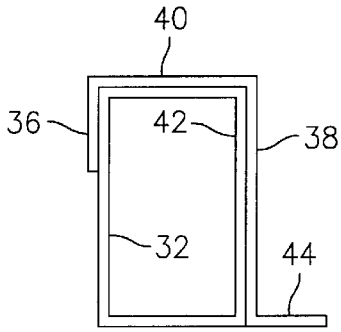
FIG. 4 is an end view showing the cover positioned over the sidewall member.

As shown in FIG. 3, a water impervious member 28, such as a plastic sheet, may be placed over the sidewall member or members 16 forming a sidewall 12 or 14. The water impervious member 28 extends from sidewall 12 to sidewall 16, from end wall 20 to end wall 22, and over each of the corner members 24. While it is preferred to use a single water impervious member 28 to cover the enclosed area 26, more than one water impervious member 28 may be used if desired. As can be seen from FIG. 3, the water impervious member 28 preferably has a portion 30 which extends over the outer surface 32 of each sidewall member 16.

To hold the water impervious member 28 in place, a cover member 34 is placed over the water impervious member 28 and a respective sidewall member 16. The cover member 34 has a first leg 36 which extends along the outer wall 32 of the sidewall member 16 and a second leg 38 substantially parallel to the first leg 36. The second leg 38 is joined to the first leg 36 by a connecting member 40. The second leg 38 extends downwardly from the connecting member 40 along an inner wall 42 of the sidewall member 16. As can be seen from FIG. 3, the first leg 36 is shorter than the second leg 38. The second leg 38 has an integrally formed, inwardly projecting sealing flange 44. When water is placed over the water impervious member 28 or when the water is turned into ice 46, the water and/or ice press against the flange 44 which in turn holds the water impervious member 28 tightly against the inner wall 42. The leg 38 and the flange 44 also protect the water impervious member 28 from being cut by a sharp instrument such as an ice skate blade.

The cover member 34 is also preferably formed from a lightweight plastic material which is slightly flexible to allow the cover member 34 to snap in place over the sidewall member 16. Each cover member 34 preferably has a length which is substantially the same as the length of a respective side wall member 16.

Figure 6:
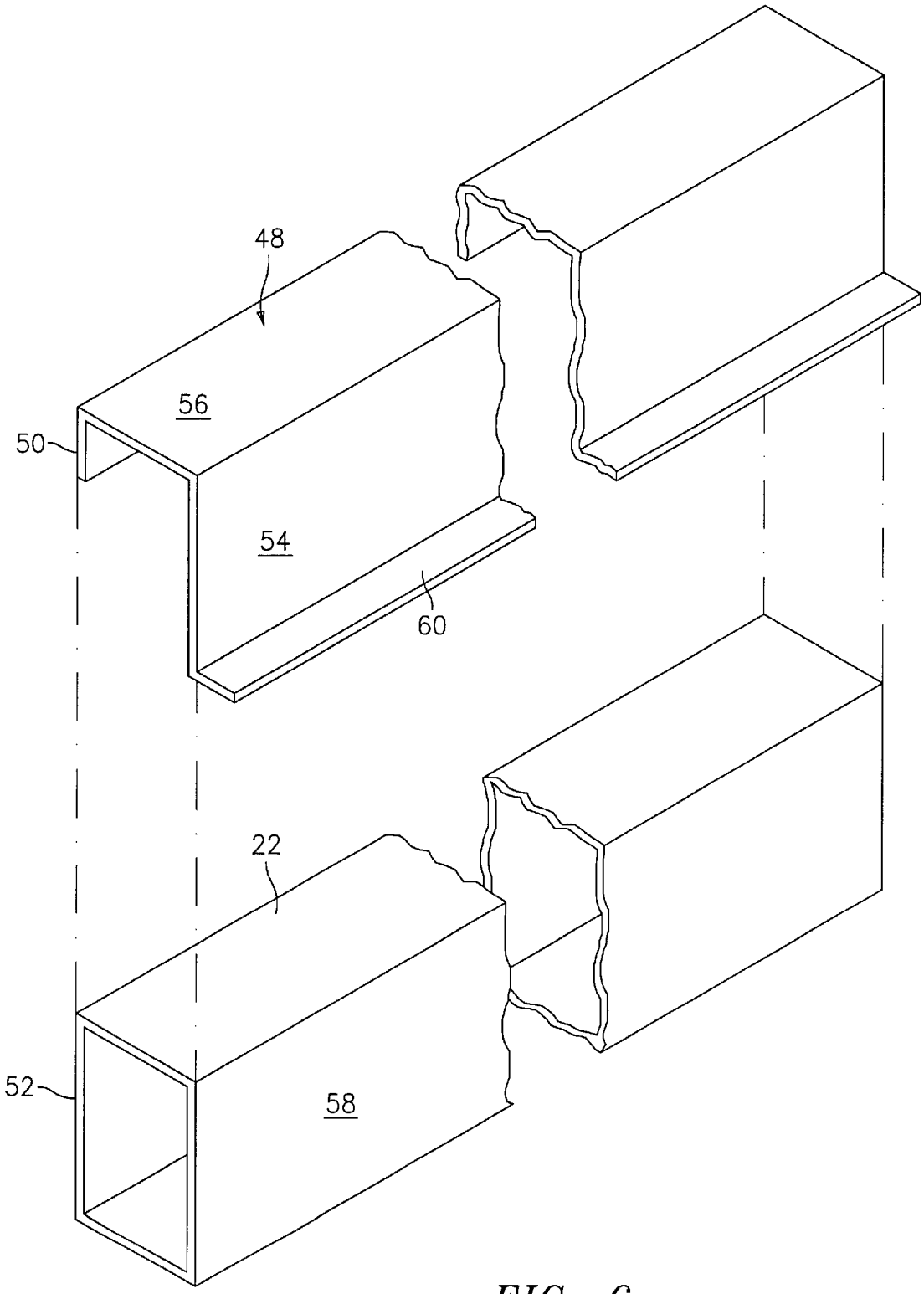
FIG. 6 is an exploded view of an end wall member of the enclosure having a cover thereon.
Figure 7:
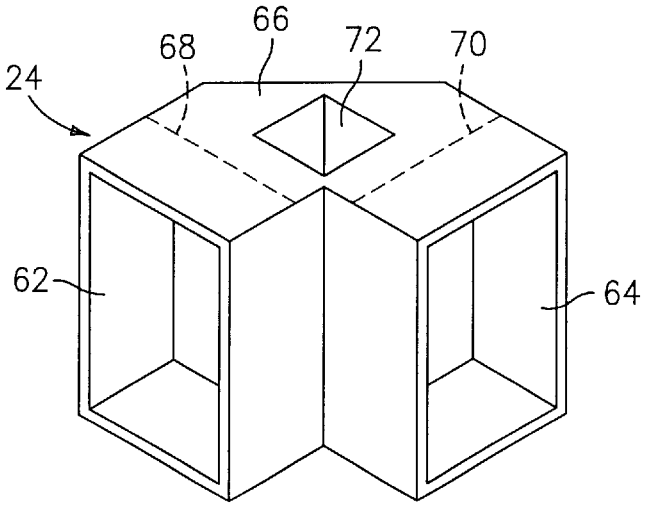
FIG. 7 is a perspective view of a corner member of the enclosure of FIG. 1.
Figure 8:
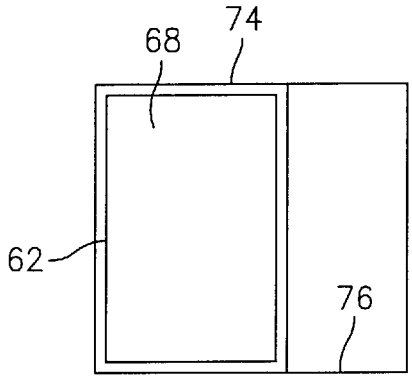
FIG. 8 is an end view of the corner member of FIG. 7.
Figure 9:
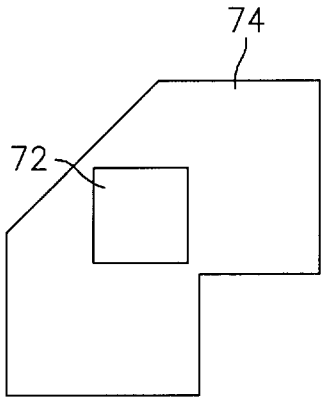
FIG. 9 is a top view of the corner member of FIG. 7.
Figure 10:
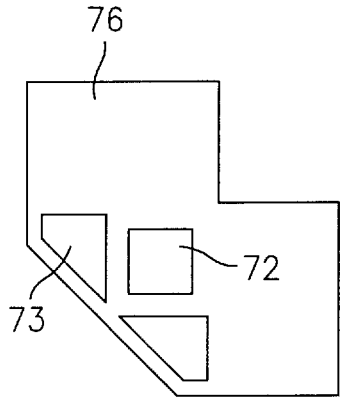
FIG. 10 is a bottom view of the corner member of FIG. 7.
Figure 11:
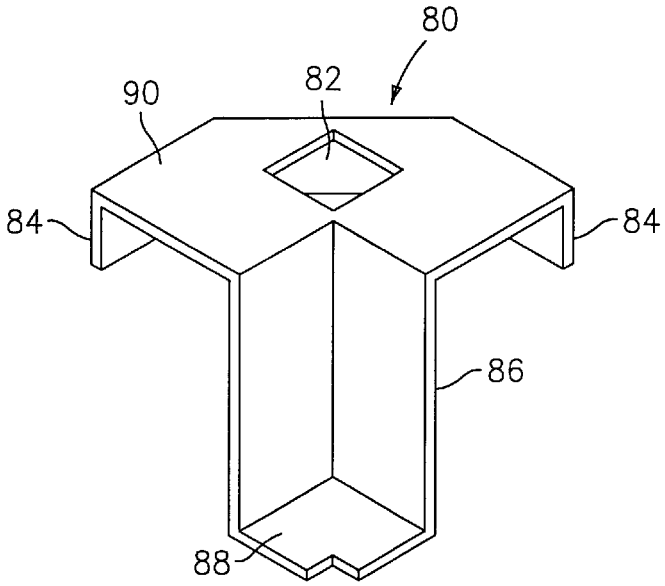
FIG. 11 is a perspective view of a cover which fits over the corner member of FIG. 7.
Figure 12:
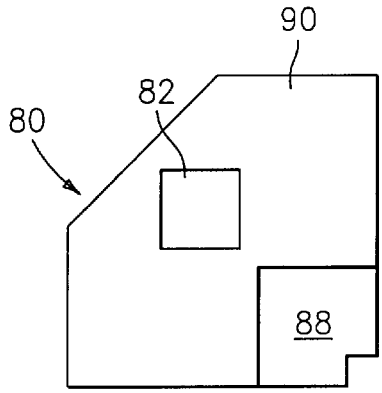
FIG. 12 is a top view of the cover of FIG. 11.
Figure 13:
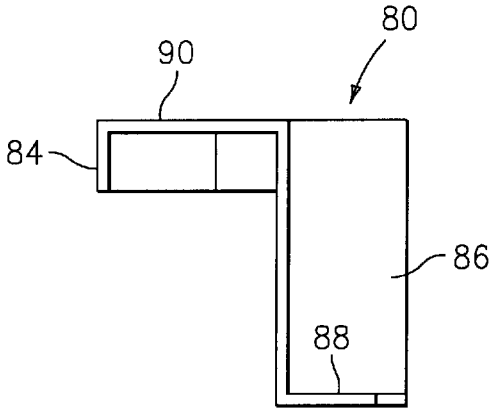
FIG. 13 is a side view of the cover of FIG. 11.
Figure 14:
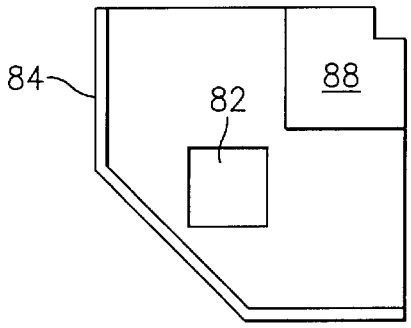
FIG. 14 is a bottom view of the cover of FIG. 11.
Figure 15:
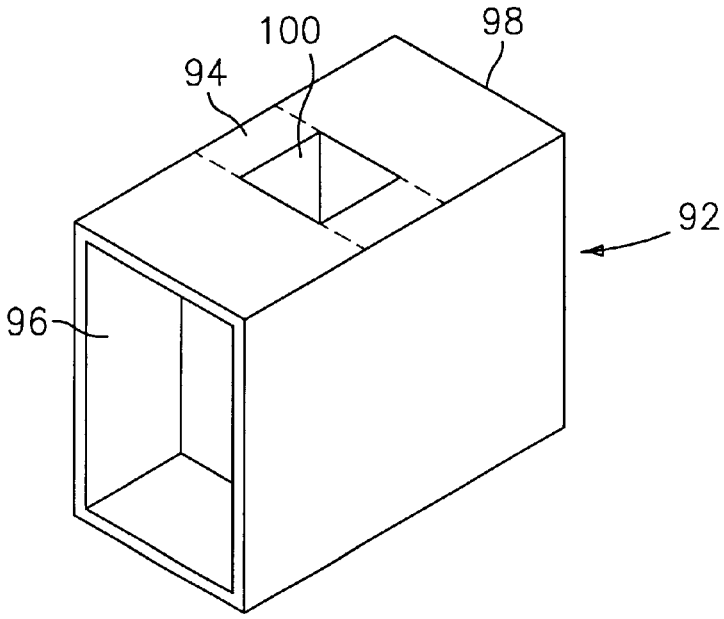
FIG. 15 is a perspective view of a connecting element used to join two sidewall or end wall members together.
Figure 16:
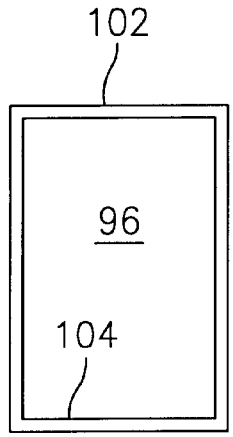
FIG. 16 is an end view of connecting element of FIG. 15.
Figure 17:
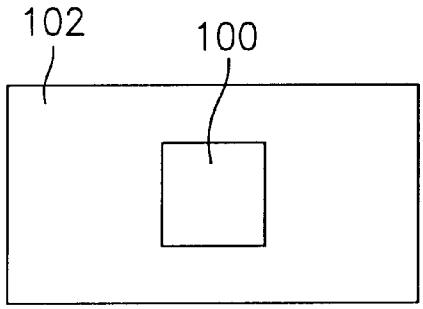
FIG. 17 is a top view of the connecting element of FIG. 15.
Figure 18:
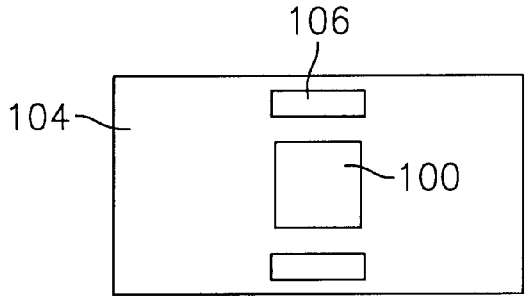
FIG. 18 is a bottom view of the connecting element of FIG. 15.

Referring now to FIG. 6, an exploded view of an end wall member 22 and an end wall cover 48 are shown. The end wall member 22 is also preferably formed from a lightweight plastic material and has a hollow, substantially rectangular or substantially square cross section.

The end wall cover 48 has the same configuration as the cover member 34. It has a first leg 50 which fits over a portion of an outer wall 52 of the end wall member 22 and a second leg 54 which extends substantially parallel to said first leg 50. The second leg 54 is joined to the first leg 50 by a connecting member 56 and has a length greater than the length of the leg 52. The second leg 54 extends over an interior wall 58 of the end wall member 22. A sealing flange 60 is integrally formed with the second leg 54 and projects inwardly from the interior wall 58. The flange 60 with the leg 54 helps protect the water impervious member 28 from being cut with a sharp instrument such as an ice skate blade. The cover 48 is also used to hold and protect the water impervious member 28.

The cover 48 is preferably formed from a flexible lightweight plastic material which allows it to be snapped over the end wall member 22. The cover 48 also has a length which is substantially equal to the length of the side wall member 22.

A plurality of corner members 24 are used to form the enclosure area 26. Each corner member 24 joins an end portion of a sidewall member 16 and an end portion of an end wall member 22.

As shown in FIGS. 7–10, each corner member 24 is substantially L-shaped and has a first portion 62 for receiving an end portion of either a sidewall member 16 or an end wall member 22 and a second portion 64 for receiving an end portion of either a sidewall member 16 or an end wall member 22.

Each corner member 24 also has a central portion 66 which is preferably separated from the first and second portions 62 and 64 by walls 68 and 70. The central portion 66 of each corner member 24 has an integrally formed slot 72 which preferably extends from the top surface 74 to the bottom surface 76 of the corner member 24. As can be seen from FIG. 1, the slot 72 receives a pole 78. The depth of the slot 72 helps insure that the pole 78 is properly supported in an upright position. The slot 72 may have any desired cross section shape. Preferably, the slot 72 has a substantially square or rectangular cross section.

Each corner member 24 may be provided with a plurality of slots 73 to reduce the weight of the corner member 24 or alternatively to receive an end of a positioning member (not shown) for locating the corner member 24 in a particular ground location.

As previously mentioned, the water impervious member 28 is positioned so that it drapes over at least a portion of the corner member 24. To secure the water impervious member 28 in position, a corner member cover 80 is positioned over the corner member 24. Referring now to FIGS. 11–14, the cover 80 has a shape which substantially corresponds to the shape of the corner member 24. The cover 80 also has a slot 82 which aligns with the slot 72 and has the same cross section shape as the slot 72. The water impervious member 28 may be shaped so that the slots 72 and 82 are not covered by it. Alternatively, the water impervious member 28 may be provided with a slot (not shown) which aligns with the slots 72 and 82.

As with the other covers, the cover 80 has a first leg 84 which extends over an outer wall of the corner member 24 and a second leg 86 which extends over an inner wall of the corner member 24. The second leg 86 has a length greater than the length of the first leg 84. The second leg 86 is L-shaped to conform with the shape of the corner member 24. The second leg 84 has an integrally formed sealing flange 88 which is inwardly directed and lies under the water and/or a layer of ice formed in the enclosure. A connecting portion 90 joins the first leg 84 to the second leg 86. The connecting portion 90 has a shape which corresponds to the shape of the upper surface of the corner member 24.

Each corner member 24 is preferably formed from a lightweight plastic material. Each corner cover 80 is also formed from a plastic material. Preferably, the plastic material forming the cover 80 is flexible to allow the cover 80 to be snapped fit over the corner member 24.

As can be seen from FIG. 1, each sidewall 12 and 14 may be formed from more than one elongated sidewall member 16. In such a situation, a connecting member 92 is used to join adjacent sidewall members 16.

Each connecting member 92 has a central portion 94 and first and second end portions 96 and 98 for receiving end portions of the sidewall members 16.

A slot 100 is integrally formed in the central portion 94. The slot 100 extends through the connecting member 92 from the top surface 102 to the bottom surface 104. The slot 100 is shaped to correspond to the shape of the pole 78. For example, the slot 100 may be substantially square in shape. The depth of the slot 100 helps insure that the pole 78 is held upright. The water impervious member 28 may be provided with a slot (not shown) or a cut-out section (not shown) which allows the water impervious member to be positioned over the upper surface 102 of the connecting member without interfering with the slot 100 and the introduction of a pole 78.

If desired, the bottom surface 104 of the connecting member 92 may have a pair of slots 106. The slots 106 may be used to receive members (not shown) for securing the connecting member 92 to a particular ground location or merely to reduce the weight of the connecting member 92.

The poles 78 may be used to support a protective structure such as netting. Any suitable conventional means (not shown) known in the art may be used to connect the protective structure to each of the poles 78.

If desired, the height of each sidewall 12 and 14 and each end wall 18 and 20 can be increased by stacking sidewall members 16, connecting members 92, end wall members 22, and corner members 24 using the poles 78 and the slots 72 and 100. Increasing the height of the sidewalls 12 and 14 and the end walls 18 and 20 would be desirable if the enclosure is to be used as a wading pool.

If the enclosure 10 is to be used as a garden enclosure to protect plants from animals and rodents, the water impervious member 28 may be omitted and replaced by a perforated sheet member 28 formed from a plastic material. The perforated sheet of plastic material would allow seeds to be planted, yet prevent the growth of weeds. The perforations in the sheet would also allow water to reach the roots of the plants.

As can be seen from the foregoing description, a multi-use enclosure has been described. The enclosure 10 is formed from light weight components which can be easily assembled and disassembled. No special tools are required to assemble or disassemble the enclosure 10. Further, the enclosure 10 does not require the use of any screws, nuts, bolts, and the like.

The enclosure 10 is portable since it can be disassembled and is lightweight. Further, it can be erected on any surface including but not limited to concrete surfaces and wooden surfaces. If desired, the enclosure 10 when erected on a concrete surface could be used as a roller hockey rink. Still further, the enclosure 10 may be erected in one's backyard. Finally, the enclosure 10 may be easily stored when not in use.

It is apparent that there has been provided a portable ice skating rink enclosure which fully satisfies the objects, means and advantages set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations as fall within the broad scope of the appended claims.

What is claimed is:

1. An enclosure which comprises:

pair of opposed sidewalls and a pair of opposed end walls;

each of said sidewalls being defined by at least one elongated sidewall member;

each of said end walls being defined by at least one elongated end wall member;

a plurality of corner members defining an enclosure area with said end walls and said sidewalls;

each of said corner members being positioned between one of said sidewalls and one of said end walls;

at least one sheet member fitting over said sidewalls, said end walls, and said corner members;

said at least one sheet member extending from a bottom edge of a first one of said sidewalls to a bottom edge of a second one of said sidewalls and from a bottom edge of a first one of said end walls to a bottom edge of a second one of said end walls and forming a bottom surface for said enclosure; and means for holding said at least one sheet member in place and for protecting said at least one sheet member along said sidewalls and said end walls from being cut by a sharp instrument.

2. An enclosure according to claim 1, wherein each of said at least one elongated sidewall member, said at least one elongated end wall member, and said corner members are formed from a plastic material.

3. An enclosure according to claim 1, wherein each said at least one elongated sidewall member and each said elongated end wall member has a square cross section.

4. An enclosure according to claim 1, wherein each said at least one elongated sidewall member and each said at least one elongated end wall member has a rectangular cross section.

5. An enclosure according to claim 1, wherein said at least one sheet member comprises at least one water impervious sheet member.

6. An enclosure which comprises:

a pair of opposed sidewalls and a pair of opposed end walls;

each of said sidewalls being defined by at least one elongated sidewall member;

each of said end walls being defined by at least one elongated end wall member;

a plurality of corner members defining an enclosed area with said end walls and said sidewalls;

each of said corner members being positioned between one of said sidewalls and one of said end walls;

at least one sheet member fitting over said sidewalls, said end walls, and said corner members;

means for holding said at least one sheet member in place and for protecting said at least one sheet member along said sidewalls and said end walls from being cut by a sharp instrument; and said holding and protecting means comprising a sidewall cover member having a first leg which fits over an outer wall of said at least one elongated sidewall member, a second leg substantially parallel to said first leg which fits over an inner wall of said at least one elongated sidewall member, a sealing flange member attached to said second leg, and an interconnecting member connecting said first leg to said second leg.

7. An enclosure according to claim 6, wherein said first leg is shorter than said second leg and wherein said sidewall cover member has a length substantially equal to a length of said elongated sidewall member.

8. An enclosure which comprises:

a pair of opposed sidewalls and a pair of opposed end walls;

each of said sidewalls being defined by at least one elongated sidewall member;

each of said end walls being defined by at least one elongated end wall member;

a plurality of corner members defining an enclosed area with said end walls and said sidewalls;

each of said corner members being positioned between one of said sidewalls and one of said end walls;

at least one sheet member fitting over said sidewalls, said end walls, and said corner members;

means for holding said at least one sheet member in place and for protecting said at least one sheet member along said sidewalls and said end walls from being cut by a sharp instrument; and said holding and protecting means comprising an end wall cover member which has a first leg which fits over an outer wall of said at least one elongated end wall member, a second leg substantially parallel to said first leg which fits over an inner wall of said at least one elongated end wall member, a sealing flange member attached to an end of said second leg, and an interconnecting member connecting said first and second legs.

9. An enclosure according to claim 8, wherein said first leg is shorter than said second leg and wherein said end wall cover member has a length substantially equal to a length of said at least one elongated end wall member.

10. An enclosure which comprises:

a pair of opposed sidewalls and a pair of opposed end walls;

each of said sidewalls being defined by at least one elongated sidewall member;

each of said end walls being defined by at least one elongated end wall member;

a plurality of corner members defining an enclosed area with said end walls and said sidewalls;

each of said corner members being positioned between one of said sidewalls and one of said end walls;

at least one sheet member fitting over said sidewalls, said end walls, and said corner members;

means for holding said at least one sheet member in place and for protecting said at least one sheet member along said sidewalls and said end walls from being cut by a sharp instrument; and each of said corner members having an L-shaped configuration and wherein said holding and protecting means comprising an L-shaped cover for each of said corner members.

11. An enclosure according to claim 10, wherein each of said corner members has an integrally formed slot for receiving means for supporting an enclosing member and wherein each L-shaped cover has an integrally formed slot aligned with said integrally formed slot of said corner member.

12. An enclosure according to claim 11, wherein each of said slots is substantially square shaped.

13. An enclosure according to claim 11, wherein each of said covers has a first leg which extends over an outer wall of said corner member and a second leg which extends over an inner wall of said corner member.

14. An enclosure according to claim 13, wherein said second leg has an L-shape and wherein a sealing flange member is joined to said second leg.

15. An enclosure according to claim 11, wherein said enclosing member supporting means comprises a pole.

16. An enclosure according to claim 11, wherein each of said sidewalls is defined by at least two elongated sidewall members and a connector element and wherein said connector element has an integrally formed slot for receiving an enclosing member supporting means.

17. An enclosure according to claim 16, wherein each of said enclosing member supporting means comprises a pole.

18. An enclosure according to claim 17, further comprising a netting attached to each of said poles.

19. An enclosure according to claim 16, wherein said connecting element has a central portion and two end portions for receiving an end portion of a respective elongated sidewall member.

20. An enclosure according to claim 19, wherein said connecting element further has a first wall separating said central portion from a first one of said end portions and a second wall separating said central portion from a second one of said end portions.

21. An enclosure according to claim 11, wherein each of said corner members has a central portion, a first end portion for receiving an end of said at least one elongated sidewall member, and a second end portion for receiving an end of said at least one elongated end wall member.

22. An enclosure according to claim 21, further comprising a first wall separating said first end portion from said central portion and a second wall separating said second end portion from said central portion.

23. A portable ice skating rink comprising:

a pair of opposed sidewalls and a pair of opposed end walls;

each of said sidewalls being defined by at least one elongated sidewall member;

each of said end walls being defined by at least one elongated end wall member;

a plurality of corner members;

each of said corner members joining one of said sidewalls to one of said end walls;

at least one sheet of water impervious material being positioned over portions of said sidewalls, said end walls, and said corner members;

means for holding said at least one sheet in place and for protecting said water impervious material along said sidewalls and said end walls from being cut by a sharp instrument; and said holding means comprising a sidewall member cover, an end wall member cover, and a corner member cover.

24. A portable ice skating rink according to claim 23, wherein each of said covers has an integrally formed flange which is positioned beneath a layer of ice formed in said rink.

25. A portable ice skating rink comprising:

a pair of opposed sidewalls and a pair of opposed end walls;

each of said sidewalls being defined by at least one elongated sidewall member;

each of said end walls being defined by at least one elongated end wall member;

a plurality of corner members;

each of said corner members joining one of said sidewalls to one of said end walls;

at least one sheet of water impervious material being positioned over portions of said sidewalls, said end walls, and said corner members;

means for holding said at least one sheet in place and for protecting said water impervious material along said sidewalls and said end walls from being cut by a sharp instrument; and each said corner member having a slot for receiving a supporting pole.

26. A portable ice skating rink according to claim 25, wherein each of said sidewalls is formed from at least two sidewall members and further comprising at least one connecting element for joining adjacent ones of said sidewall members.

27. A portable ice skating rink according to claim 26, wherein said at least one connecting element has a slot for receiving a supporting pole.

28. A portable ice skating rink comprising:

a pair of opposed sidewalls and a pair of opposed end walls;

each of said sidewalls being defined by at least one elongated sidewall member;

each of said end walls being defined by at least one elongated end wall member;

a plurality of corner members;

each of said corner members joining one of said sidewalls to one of said end walls;

at least one sheet of water impervious material being positioned over portions of said sidewalls, said end walls, and said corner members;

means for holding said at least one sheet in place and for protecting said water impervious material along said sidewalls and said end walls from being cut by a sharp instrument; and a plurality of poles extending upwardly from said corner members and said sidewalls and protective netting positioned between adjacent ones of said poles.

* * * * *